US006240269B1

(12) United States Patent
Kaya et al.

(10) Patent No.: US 6,240,269 B1
(45) Date of Patent: May 29, 2001

(54) IMAGE FORMING APPARATUS HAVING A PHOTOSENSITIVE MEMBER OF AMORPHOUS SILICON BASE AND SYSTEM FOR EXPOSING AND CHARGING THE PHOTOSENSITIVE MEMBER

(75) Inventors: Takaaki Kaya, Mishima; Masaya Kawada, Nara; Tetsuya Karaki, Shizuoka-ken; Toshiyuki Ehara; Yuji Nakayama, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/301,582

(22) Filed: Apr. 29, 1999

(30) Foreign Application Priority Data

May 6, 1998 (JP) ..... 10-123476
Nov. 27, 1998 (JP) ..... 10-337941
Dec. 8, 1998 (JP) ..... 10-349022

(51) Int. Cl.[7] ..... G03G 15/00
(52) U.S. Cl. ..... 399/128; 399/127; 399/177
(58) Field of Search ..... 399/26, 128, 130, 399/159, 162, 177, 220; 430/31, 57, 58, 60, 62, 64, 65, 66, 83

(56) References Cited

U.S. PATENT DOCUMENTS 3,659,936 * 5/1972 Klose et al. ..... 399/128
4,489,149 * 12/1984 Kawamura et al. ..... 430/65
4,683,184 * 7/1987 Osawa et al. ..... 430/57
5,631,727 5/1997 Ehara et al. .
5,701,560 12/1997 Tsujita et al. ..... 399/159

FOREIGN PATENT DOCUMENTS 54-83746 7/1979 (JP) .
57-11556 1/1982 (JP) .
57-158650 9/1982 (JP) .
58-143364 8/1983 (JP) .
59-133569 7/1984 (JP) .
60-67951 4/1985 (JP) .
60-95551 5/1985 (JP) .
60-35059 8/1985 (JP) .
60-242484 12/1985 (JP) .
62-168161 7/1987 (JP) .
63-149669 6/1988 (JP) .

* cited by examiner

*Primary Examiner*—Arthur T. Grimley
*Assistant Examiner*—Hoang Ngo
(74) *Attorney, Agent, or Firm*—Fitzpatrick, Cella, Harper and Scinto

(57) ABSTRACT

An electrophotographic process is implemented with improved ghost memory and with high chargeability even under circumstances of increased process speed or compactified structure and the electrophotographic process forms an image on a photosensitive member having a photosensitive layer through a series of steps including steps of charge elimination, charging, latent image exposure, and development to form a toner image, wherein light used in the latent image exposure step is light of a wavelength within such a range that a value of (optical memory before charging)/(sensitivity) of the photosensitive layer is not more than 1.5 times a minimum value. The optical memory before charging means lowering in chargeability due to light irradiation before charging.

51 Claims, 11 Drawing Sheets

IMAGE FORMING APPARATUS HAVING A PHOTOSENSITIVE MEMBER OF AMORPHOUS SILICON BASE AND SYSTEM FOR EXPOSING AND CHARGING THE PHOTOSENSITIVE MEMBER

BACKGROUND OF THE INVENTION

1. Field of the Invention

The present invention relates to an electrophotographic process and an electrophotographic apparatus and, more particularly, to an electrophotographic process using an amorphous silicon base photosensitive member (a-Si photosensitive member) and an electrophotographic apparatus having the photosensitive member.

2. Related Background Art

The a-Si photosensitive members have characteristics of high surface hardness, high sensitivity to long-wavelength light of semiconductor lasers (770 nm to 800 nm) etc., little deterioration after repetitive use, and so on and are commercially used as photosensitive members for electrophotography, particularly, for high-speed copying machines, LBPs (laser beam printers), and so on.

FIG. 1 is a schematic, structural view for explaining an example of the image forming process in an electrophotographic apparatus using the a-Si photosensitive member, in which around a photosensitive member 401 arranged to rotate in the direction of arrow R1 there are provided a primary charger 402, an electrostatic latent image forming section 403, a developing unit 405, a transfer sheet supplying system 406, a transfer charger 407*a*, a separation charger 407*b*, a cleaner 409, a conveying system 410, a charge-eliminating light source 411, and so on. Normally, a corona charger excellent in uniform charging is widely used as the primary charger 402.

The image forming process will be described below with the above example. The photosensitive member 401 is uniformly charged by the primary charger 402 to which the high voltage of +6 to 8 kV is applied. Light is guided from the electrostatic latent image forming section 403 to be projected onto the photosensitive member 401 to form an electrostatic latent image thereon. A negative toner is supplied from the developing unit 405 onto the latent image to form a toner image. On the other hand, a transfer sheet P is supplied through the transfer sheet supplying system 406 to the photosensitive member and a positive electric field, which is of a polarity opposite to the polarity of the toner, is applied thereto from the back in a gap between the photosensitive member 401 and the transfer charger 407*a* to which the high voltage of +7 to 8 kV is applied. This causes the negative toner image on the surface of the photosensitive member to be transferred onto the transfer sheet P. The transfer sheet P is separated by the separation charger 407*b* to which the high AC voltage of 12 to 14 kvp-p and 300 to 600 Hz is applied and it is conveyed through the transfer sheet conveying system 410 to a fixing device (not illustrated), in which the toner image is fixed. The transfer sheet P is then discharged out of the apparatus.

In the electrophotography, a photoconductive material for forming the photosensitive layer in the photosensitive member needs to have the following characteristics; high sensitivity, high SN ratio [photocurrent (Ip)/dark current (Id)], an absorption spectrum compatible with spectral characteristics of electromagnetic waves to be radiated thereto, quick optical response, and desired dark resistance, and harmlessness to the human body during use, and so on. Particularly, in the case of the photosensitive members for image-forming apparatus incorporated in the image-forming apparatus used as business machines in offices, a nonpolluting property during the aforementioned use is a significant point. One of the photoconductive materials demonstrating excellent properties in the aforementioned aspects is hydrogenated amorphous silicon (which will be referred to as "a-Si:H"). For example, Japanese Patent Publication No. 60-35059 describes an application thereof to the photosensitive member for image-forming apparatus.

The photosensitive members for image-forming apparatus using a-Si:H are generally made by heating a conductive support at 50° C. to 400° C. and forming a photoconductive layer comprised of a-Si on the support by a film forming method such as a vacuum evaporation method, a sputtering method, an ion plating method, a thermal CVD method, a photo CVD method, a plasma CVD method, or the like. Among them the plasma CVD method, which is a method for decomposing a source gas by direct current or high-frequency or microwave glow discharge to form an a-Si deposited film on the support, is practically used as a preferred method.

For example, Japanese Patent Application Laid-Open No. 54-83746 suggests the photosensitive member for image-forming apparatus comprised of an electroconductive support and a photoconductive layer made of a-Si containing halogen atoms as a constituent (hereinafter referred to as "a-Si:X"). This application describes that when a-Si contains 1 to 40 atomic % halogen atoms, the photoconductive layer has high heat resistance and good electrical and optical characteristics as a photoconductive layer of the photosensitive member for image-forming apparatus.

Japanese Patent Application Laid-Open No. 57-11556 describes the technology of forming a surface layer of a non-photoconductive amorphous material containing silicon atoms and carbon atoms, on the photoconductive layer of an amorphous material containing silicon atoms as a matrix in order to improve the electrical, optical, and photoconductive properties including the dark resistance, photosensitivity, optical response, and so on, operating environment characteristics such as humidity resistance and the like, and temporal stability of the photoconductive member having the photoconductive layer comprised of the a-Si deposited film.

Further, Japanese Patent Application Laid-Open No. 60-67951 describes the technology of the photosensitive member in which a light transmissive insulating overcoat layer comprised of amorphous silicon containing carbon, oxygen, and fluorine is stacked, and Japanese Patent Application Laid-Open No. 62-168161 describes the technology using an amorphous material containing silicon atoms, carbon atoms, and 41 to 70 atomic % hydrogen atoms, as a surface layer.

Further, Japanese Patent Application Laid-Open No. 57-158650 describes that the photosensitive member for image-forming apparatus with high sensitivity and high resistance can be obtained by using a photoconductive layer comprised of a-Si:H containing 10 to 40 atomic % hydrogen, wherein the absorption coefficient ratio of absorption peaks at 2100 $cm^{-1}$ and at 2000 $cm^{-1}$ in an infrared absorption spectrum is 0.2 to 1.7.

On the other hand, Japanese Patent Application Laid-Open No. 60-95551 discloses the technology for preventing lowering in surface resistance due to adsorption of water in the surface of the photosensitive member and image smearing occurring therewith by carrying out the image forming process including charging, exposure, development, and transfer while maintaining the temperature of the vicinity of the surface of the photosensitive member at 30° C. to 40° C. in order to improve the quality of image of the amorphous silicon photosensitive member.

These technologies improved the electrical, optical, and photoconductive characteristics and the operating environment characteristics of the photosensitive members for image-forming apparatus and also improved the image quality therewith.

Further, in order to prevent and eliminate the aforementioned image smearing of the photosensitive member at a high humidity, it is known to heat the photosensitive member by a heat source disposed on the internal surface side of the photosensitive member, for example, by an electric heater of a surface or rod shape disposed on the internal surface side of the cylindrical photosensitive member.

However, the continuous heating by the heater for prevention of the image smearing increases power consumption, as described above. Capacities of such heaters are normally approximately 15 W to 80 W, which do not always seem large electric energy. In most cases the apparatus is always powered throughout the day including the nighttime. The power consumption per day for the heating could reach 5–15% of the total power consumption of the image-forming apparatus in certain cases.

Incidentally, with progress in increase of functions of the electrophotographic apparatus and in space savings of offices etc., there have been increasing desires for machines having the space saving effect, multiple functions, and high copy speed. It is thus necessary to design the apparatus with consideration to the tendency toward high speed, downsizing, and multi-functioning from the designing aspect.

With progress in the tendency toward the high-speed operation, downsizing, and multi-functioning of the electrophotographic apparatus, however, the charging device becomes smaller and the process speed becomes higher. These factors decrease the pass time of the photosensitive member in the charger and this makes it difficult to achieve high charging on the surface of the photosensitive member, i.e., to charge the surface of the photosensitive member sufficiently. From the aspect of energy savings, there are also desires for further decrease of power consumption of the entire electrophotographic apparatus by cutting off the drum heater and by lowering the current value of the charger.

Particularly, where the speed is increased further or where the size of the photosensitive member is decreased further, there will arise a significant problem as to the charging. In the case of the speed increase, even if the width of the charger is kept equal, a time in which a certain point of the photosensitive member passes through the inside of the charger, that is, a time for charging thereof, becomes shorter, so that a charge amount is decreased in some cases. In cases where the diameter of the photosensitive member of a drum shape is decreased, the width of the charger is limited thereby, and as a result, a sufficient area is not assured for the charging. This would result in failing to achieve the sufficient charging in some cases.

Another problem common to the increase of the operating speed and the decrease of the diameter of the photosensitive member is a decrease of the time in which a certain point of the surface of the photosensitive member moves from the exposure site to the charger, for the next charging of the surface of the photosensitive member. When amorphous silicon is used, the photosensitive member has the optical memory phenomenon due to exposure. Since this optical memory decreases with a lapse of time after the exposure, it is more apt to appear as a ghost in an image as the aforementioned time becomes shorter. In order to remove this ghost, it is possible to effect excessive charge-eliminating exposure, but chargeability becomes more apt to be degraded with increase of the light quantity of the charge-eliminating exposure.

If there is large temperature dependence of the characteristics of the photosensitive member even after these problems have been overcome, the temperature control of the photosensitive member by the heater cannot be omitted.

Thus, in designing the image-forming apparatus utilizing the electrophotographic process and the electrophotographic image-forming process, it is necessary to achieve improvements from the total viewpoint in the electrophotographic, physical properties and mechanical durability of the photosensitive member for image-forming apparatus so as to solve the above problems and also achieve further improvements in the charging device capable of uniformly charging the photosensitive member with high charging efficiency and in the image-forming apparatus.

Further, diameters of dots are decreased for the purpose of improving the image quality. In this case, it is necessary to enhance reproducibility of dots and it is also important to improve it in the level of the latent image.

SUMMARY OF THE INVENTION

The present invention has been accomplished in view of these problems and an object of the present invention is to provide an electrophotographic process and an electrophotographic apparatus improved in the ghost memory and having a high chargeability even if the speed of the process is increased toward high speed or even if the size of the apparatus is decreased toward a compact configuration.

Another object of the present invention is to provide an electrophotographic process and an electrophotographic apparatus that permit a decrease of the size of the photosensitive member or a further increase of the operating speed, that can decrease the size of the exposure spot, and that can achieve a further improvement in the image quality.

According to one aspect of the present invention, there is provided an electrophotographic process of forming an image through a series of steps comprising a charge eliminating step of eliminating charge from a surface of a photosensitive member having a light receiving layer, a charging step of charging the surface of the photosensitive member, a latent image exposure step of exposing the charged surface of the photosensitive member to light to form an electrostatic latent image thereon, and a development step of supplying a toner to the electrostatic latent image to develop the image to form a toner image, wherein the light receiving layer comprises an amorphous semiconductor, and wherein the light used in the latent image exposure step is light of a wavelength within such a range that a value obtained by dividing a difference between a charging potential when the photosensitive member is not exposed to light before the charging of the photosensitive member and a charging potential when the photosensitive member is charged after exposure to light of a desired wavelength, by a sensitivity at the wavelength to make the difference between the charging potentials, is not more than 1.5 times a minimum value thereof.

Another object of the present invention is to provide an electrophotographic apparatus utilizing the electrophotographic process.

According to another aspect of the present invention, there is provided an electrophotographic apparatus comprising a photosensitive member having a light receiving layer, a charge eliminating means for eliminating charge from a surface of the photosensitive member, a charging means for charging the surface of the photosensitive member, a latent image exposure means for exposing the charged surface of the photosensitive member to light to form an electrostatic latent image thereon, and a developing means for supplying a toner to the electrostatic latent image to develop the image to form a toner image, wherein the light receiving layer comprises amorphous silicon, and wherein the latent image exposure means comprises a light source having a wavelength within a range of 500 to 680 nm, as an image exposure light source.

BRIEF DESCRIPTION OF THE DRAWINGS

FIGS. 3A and 3B are views showing an example of the relationship between light radiated to the photosensitive member before charging and memory, wherein FIG. 3A shows a relation of light intensity against wavelength and FIG. 3B shows a relation of irradiation time against wavelength;

DESCRIPTION OF THE PREFERRED EMBODIMENTS

From intensive and extensive studies, the inventors have discovered that when the light radiated to the photosensitive member is light of a wavelength within a desired range, the ghost is improved even under severe conditions against the chargeability such as the increase of operating speed and the decrease of the diameter of the photosensitive member. The inventors have found that this light improves the ghost without irradiation of excessive charge-eliminating exposure, so as to prevent the degradation of chargeability due to the excessive charge-eliminating exposure, and a sufficient charging potential is obtained. This will be described below in detail.

Figure 1:
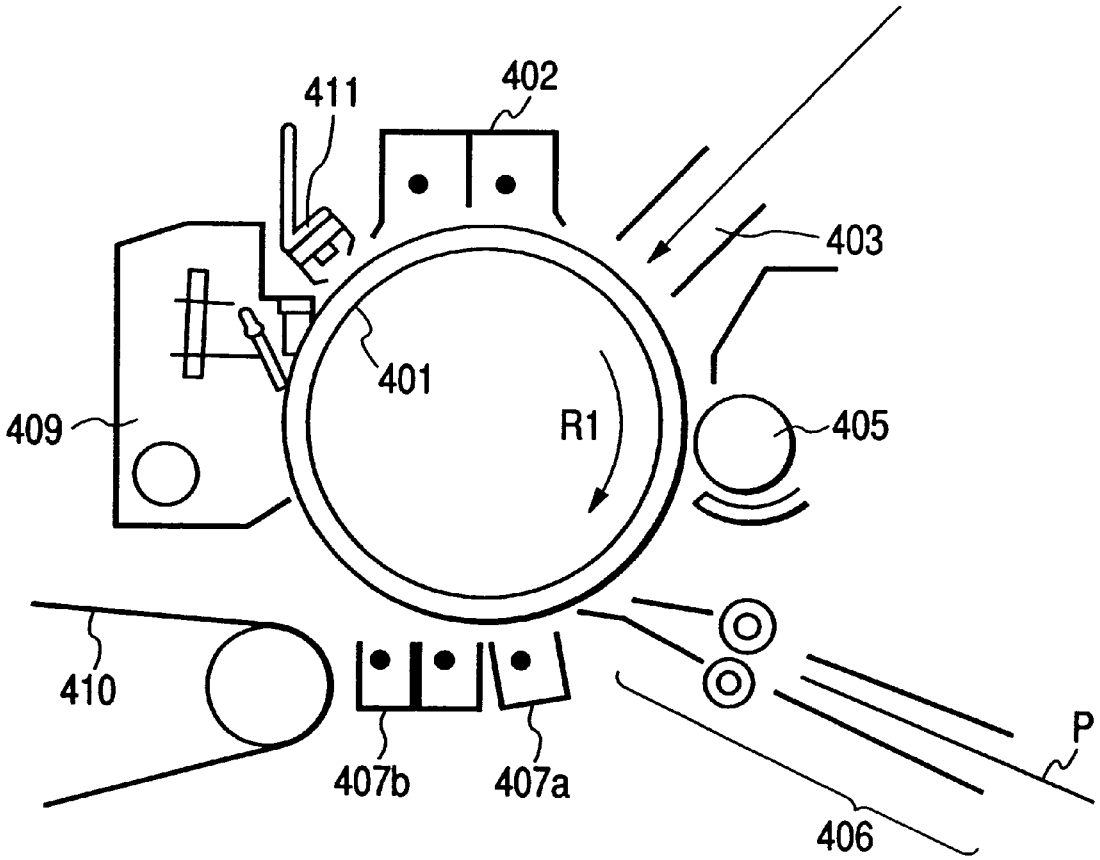
FIG. 1 is a schematic, structural view showing an example of the structure of the electrophotographic apparatus.
Figure 2:
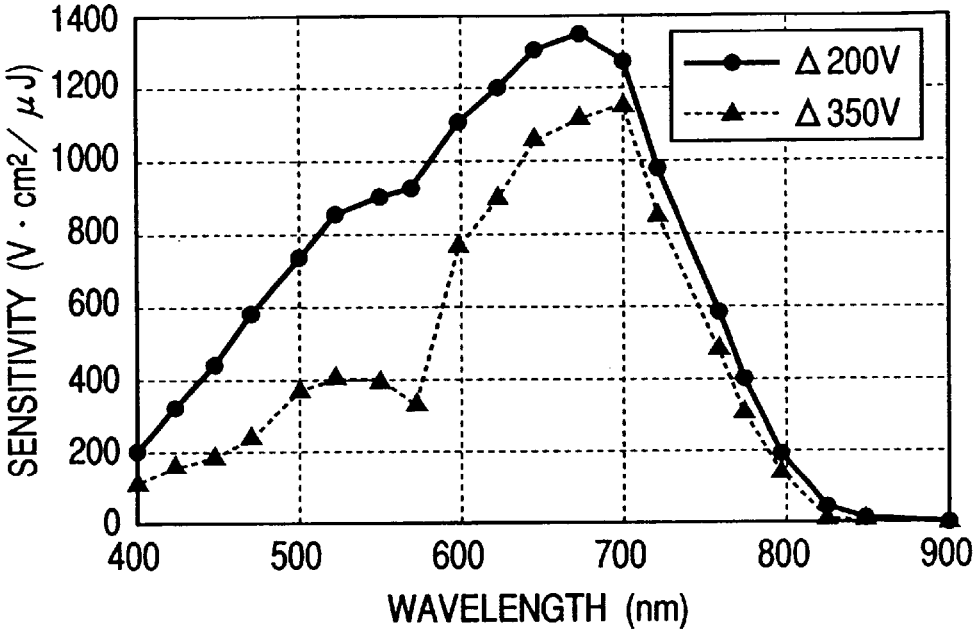
FIG. 2 is a view showing an example of sensitivity against wavelength of the amorphous silicon photosensitive member.

FIG. 2 shows the results of measurement in an example where sensitivities were measured at respective wavelengths on the amorphous silicon photosensitive member. This graph shows plots of changes (i.e., Δ200V and Δ350V; Unit: $V \cdot cm^2/\mu J$) in surface potential per unit light amount (i.e., light amount per unit area) against irradiated light of each wavelength when the amorphous silicon photosensitive member charged at 400 V in the surface was exposed to the light of each wavelength and when the surface potential reached 200 V (Δ200V) and 50 V (Δ350V).

From the result, it was verified that the amorphous silicon photosensitive member had the peak of sensitivity near 700 nm and the sensitivity suddenly dropped in the wavelength range above 700 nm. The reason why the sensitivity drops in the wavelength range over 700 nm is probably that the light in that range cannot impart sufficient energy over the bandgap to the photosensitive member.

It is thus desirable to use the wavelengths in the good sensitivity range in order to utilize the amorphous silicon photosensitive member efficiently.

However, only the use of the wavelengths in the good sensitivity range for the image exposure light source is not always sufficient for use of the amorphous silicon photosensitive member in some cases. In other words, since amorphous silicon suffers the occurrence of optical memory due to exposure, the problem of optical memory, for example the ghost, could arise in some cases where the wavelength at the highest sensitivity is simply used as the wavelength of the image exposure.

Figure 3A:
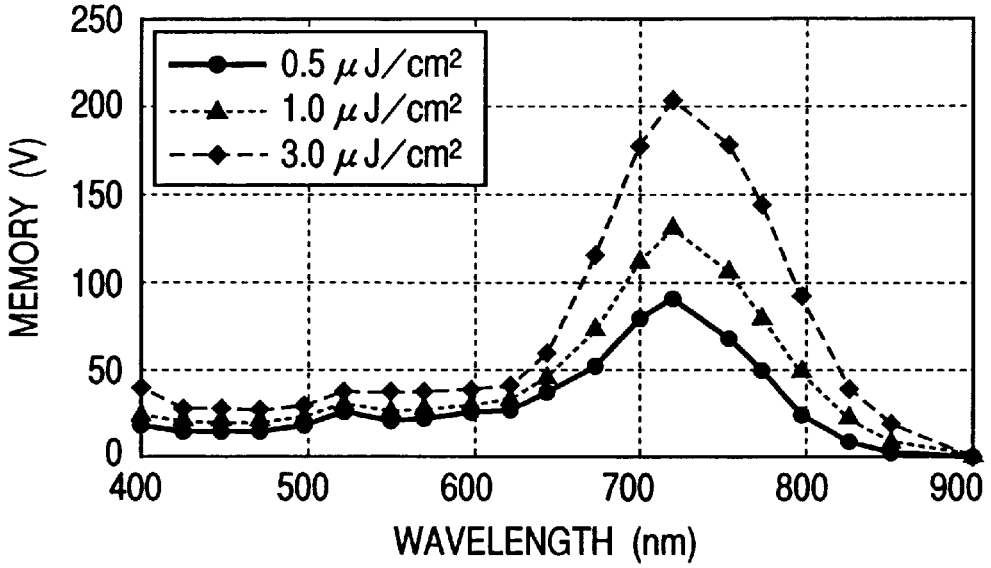
Figure 3B:
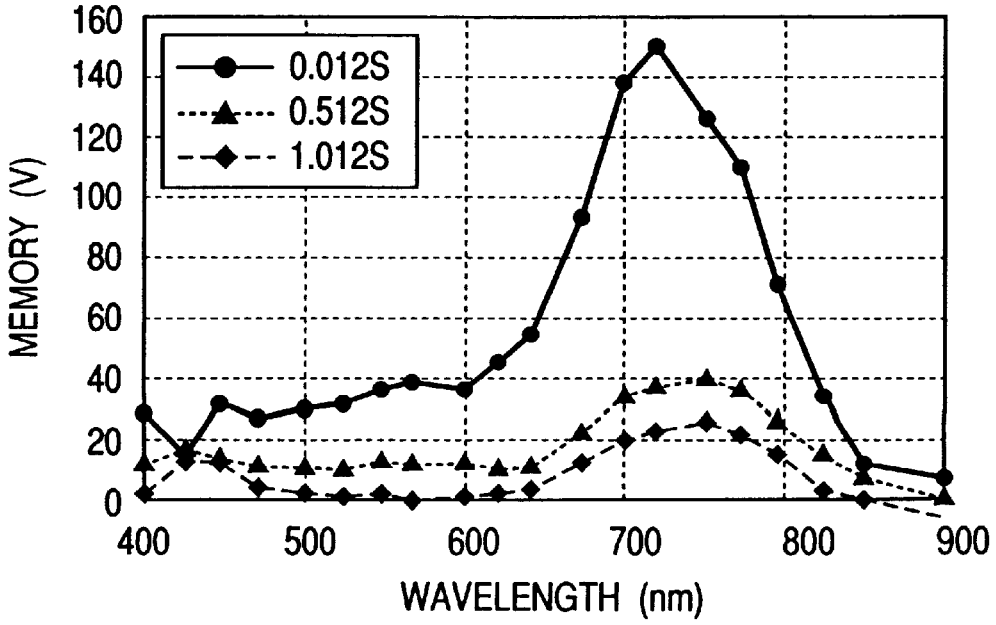

Then, the inventors have investigated the wavelength dependence of optical memory by radiating light of different wavelengths before the charging, in order to check the relationship of light irradiated before the charging with the optical memory. FIG. 3A shows decreases in chargeability (in units V) against each wavelength and each light energy of light radiated before the charging, i.e., optical memory due to light irradiation before charging (hereinafter simply referred to as "optical memory before charging"), under the condition of charging 0.012 second after light irradiation (light intensity dependence of optical memory before charging). FIG. 3B shows the optical memory before charging at each wavelength with changes of the time from the light irradiation before charging to the charging, under the condition of light intensity 1.0 $\mu J/cm^2$ (time dependence of optical memory before charging).

The optical memory before charging decreased with increasing time from light irradiation to charging, but there was little change among the peak wavelengths of the optical memory before charging. From these results, it was confirmed that the wavelength to decrease the chargeability was near 730 nm.

Based on the results of FIG. 2 and FIGS. 3A and 3B, the inventors have discovered that, in order to reduce the memory while maintaining the sensitivity, the ghost potential was decreased by decreasing the ratio of the optical memory before charging to the sensitivity of the photosensitive member, i.e., by using such image exposure as to make the value of (optical memory before charging)/(sensitivity)—in other words, the value of optical memory occurring in the unit contrast potential—as small as possible, thus accomplishing the present invention.

The most preferred wavelength of the light used for the image exposure is a wavelength at which the value of (optical memory before charging)/(sensitivity) becomes the minimum, but the sufficient effect of the present invention can also be accomplished even at other wavelengths than the wavelength for the minimum value if the wavelength is determined within such a range that the value of (optical memory before charging)/(sensitivity) is not more than 1.5 times the minimum value.

Figure 4:
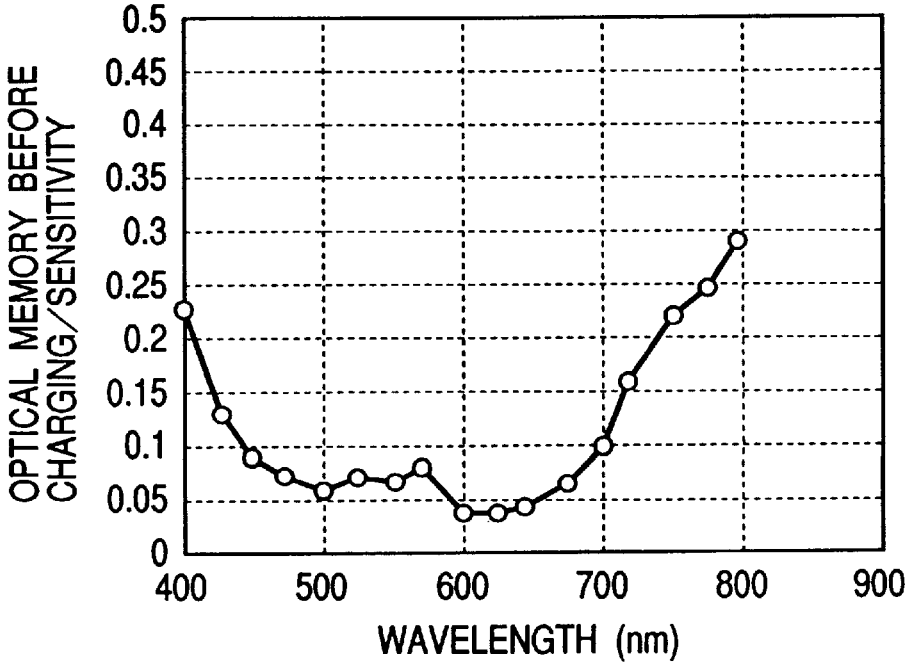
FIG. 4 is a view showing an example of the relationship between wavelengths of the radiated light and values of memory due to the radiated light to the photosensitive member before charging, over sensitivity of amorphous silicon.

FIG. 4 is an example of a graph showing the values obtained by dividing a difference between a charging potential when the photosensitive member is not irradiated with light before charging and a charging potential when the photosensitive member is charged after uniform irradiation with light of a desired wavelength, by a sensitivity at the wavelength. Specifically, as the sensitivity (Unit: $V \cdot cm^2/\mu J$), the value of the contrast difference Δ350V of FIG. 2 was adopted. It is seen from the result that the rank of ghost memory on the image is improved by using the exposure of 500 nm to 680 nm as the wavelength of image exposure. This permitted an improvement in the chargeability without degradation of ghost level. The effective range was more preferably 600 nm to 660 nm. It was thus verified that use of the image exposure light source to achieve the minimum value of the optical memory before charging over sensitivity was effective to enhancement of the chargeability of amorphous silicon even under severe conditions against the chargeability such as the increase of the operating speed and the decrease of the diameter of the amorphous silicon drum.

A conceivable reason is that the optical memory before charging is large in the range where the image exposure is not less than 660 nm and that in the wavelength range not more than 600 nm, where the light source is a single-wavelength light source such as an LED or a semiconductor laser, a residual potential becomes large enough to cause an apparent decrease of sensitivity. This is considered to be the cause of excessive irradiation of light to increase the optical memory.

When the semiconductor lasers are applied, use of these wavelengths permits decrease of dot sizes in the optical designing level, whereby the image can be obtained with higher image quality.

Now, the optimum charge-eliminating exposure will be discussed in the case of use of the above image exposure light in the present invention. When the wavelength of the charge-eliminating light is not less than 680 nm, the potential unevenness (ununiformity) tends to increase abruptly. This is probably for the reason that ununiformity of optical memory becomes more likely to occur because of the charge-eliminating light where there are irregularities in the quality of film. The occurrence of the residual potential unevenness is the cause of increase in the potential unevenness with decreasing wavelength in the short wavelength range. The inventors have found out that the wavelength of the charge-eliminating exposure light was preferably not less than 600 nm nor more than 680 nm and more preferably not less than 630 nm nor more than 680 nm in order to reduce the unevenness. Next, image exposure was conducted to evaluate the ghost potential against chargeability and it was verified that the effect of improving the ghost memory was also presented when the above range was satisfied.

This means that the image exposure light and the charge-eliminating exposure light are used more desirably within the ranges of the present invention in order to satisfy all the three points, the chargeability, ghost, and unevenness of charging potential.

In the present invention the charging can be done by corona discharge which is commonly known. The charging by the corona discharge, however, is accompanied by evolution of ozone.

The evolving ozone was discharged heretofore after it was decomposed into a nonpolluting state by use of an ozone removing filter. Particularly, in the case of personal use, the amount of ozone discharged has to be decreased as much as possible. There are thus desires for a process for drastically decreasing the amount of ozone evolving during the charging from the economical aspect as well. A charging device to meet such demand is a contact charging method, for example, as described in Japanese Patent Application Laid-Open No. 63-208878. This method is to charge a surface to be charged to a desired potential by bringing a charging member applied with a voltage into contact with the member to be charged, and it has, for example, the following advantages, as compared with the corona discharge apparatus.

The first advantage is the capability of decreasing the applied voltage necessary for obtaining the desired potential on the surface of the member to be charged. The second advantage is that the amount of ozone evolving in the charging process is from zero to an extremely small amount and thus it can obviate the need for the ozone removing filter. This can simplify the structure of an exhaust system of the apparatus and also achieve the maintenance-free performance. The third advantage is as follows; because the amount of ozone evolving in the charging process is from zero to an extremely small amount, the method can obviate the necessity for removal of moisture from the surface of the photosensitive member by the heater for heating carried out for preventing the image smearing due to the decrease of resistance of surface, which is caused when ozone and ozone products attach to an image carrier being the member to be charged, for example, to the surface of the photosensitive member whereby the surface of the photosensitive member becomes apt to adsorb water while being affected by corona products so as to be sensitive to moisture. This considerably decreases the power consumption due to energization during the nighttime or the like.

There are charging devices of the contact charging method for keeping a stationary charging member of a blade shape or a sheet shape in contact with the member to be charged and applying a charging bias thereto to effect charging.

(a) Contact Charging Device with Charging Blade

Figure 5:
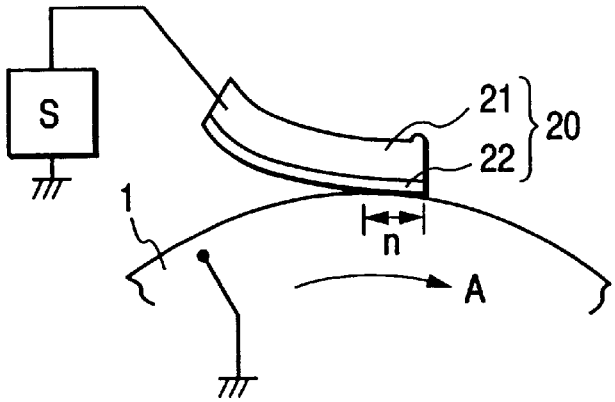
FIG. 5 is a schematic, structural view for explaining an example of contact charging apparatus.

FIG. 5 shows an embodiment of the contact charging device using a charging blade. Reference numeral 20 designates the charging blade as a contact charging member, which is composed of an electrode plate 21 and a resistive layer 22 formed on a surface of the electrode plate 21 opposite to the photosensitive member and which is placed so that the tip end portion of the charging blade 20 is in contact under a predetermined pressing force with one surface of the photosensitive member. Letter n represents a contact nip portion (charging nip portion).

The electrode plate 21 is normally made of a material selected from metals such as aluminum, aluminum alloy, brass, copper, iron, stainless steel, and the like, and materials obtained by subjecting insulating materials such as resins, ceramics, and the like to an electrically conducting treatment, i.e., to coating with a metal or coating with an electro-conductive paint.

The resistive layer 22 is generally made of a material selected from those obtained by dispersing an electroconductive filler such as titanium oxide, carbon powder, metal powder, or the like in a resin such as polypropylene, polyethylene, or the like, or in an elastomer such as silicone rubber, urethane rubber, or the like.

The resistance of the resistive layer 22 is determined to one within the range of $1\times10^3$ to $1\times10^{12}$ Ωcm in measurement at the applied voltage of 250 V to 1 kV with MΩ tester (trade name) manufactured by HIOKI Inc.

It is desirable to properly select the resistance of the charging member 20 according to the environment in which it is used, high charging efficiency, withstand voltage characteristics of the surface layer of the photosensitive member, and so on.

Letter S indicates a power supply for applying the charging bias to the charging blade 20. When the predetermined charging bias voltage is applied from the power supply S to the electrode plate 21 of the charging blade 20, the peripheral surface of the photosensitive member 1 driven to rotate is charged in a predetermined polarity and at a predetermined potential by the contact charging method.

The charging bias to the charging member 20 is applied by either a DC applying method for applying only a dc voltage Vdc or an AC applying method for applying an oscillating voltage in which an alternating voltage Vac is superimposed on the dc voltage Vdc. As an example of the AC applying method, there is a method for effecting charging by applying an oscillating voltage (a voltage which regularly changes voltage values with time) in which an alternating voltage component having a peak-to-peak voltage of two or more times a charging start voltage Vth of the member to be charged is superimposed on the dc voltage Vdc corresponding to a desired charging potential Vd, as disclosed in Japanese Patent Application Laid-Open No. 63-149669, and this method is employed for the purpose of the leveling effect of charging potentials by the alternating voltage component. The charging potentials of the member to be charged converge to Vd which is the center of the alternating voltage component, thereby uniforming the charging. The charging start voltage Vth is a voltage value applied to the charging member when the charging of the member to be charged starts with application of the dc voltage to the charging member.

(b) Contact Charging Device with Magnetic Brush

With progress of various improvements in the contact charging members there is a suggestion as a solution to above about the contact charging device with a magnetic brush using a contact charging member of a magnetic brush type composed of a magnetic member (magnet) and magnetic powder (or particles), for example, as described in Japanese Patent Application Laid-Open No. 59-133569.

The magnetic brush contact charging device is improved in characteristics including the contact property of the charging member with the member to be charged, and the like, more than in the cases using the roller type member or the blade type member or the like as a contact charging member.

Figure 6A:
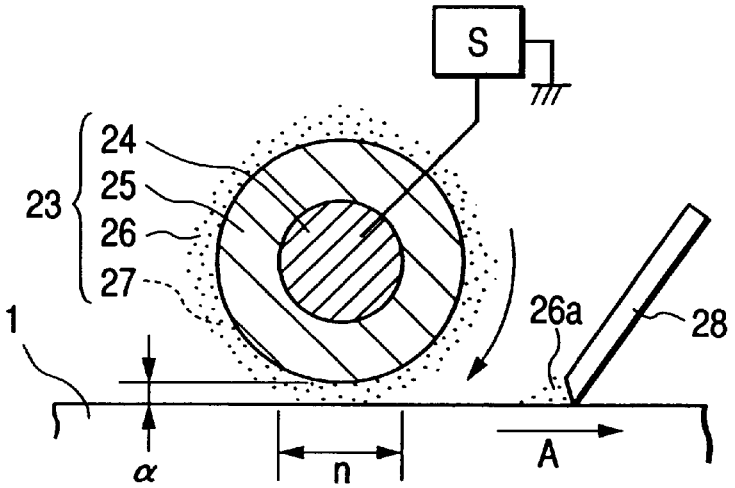
FIGS. 6A and 6B are schematic, structural views for explaining another example of the contact charging apparatus.
Figure 6B:
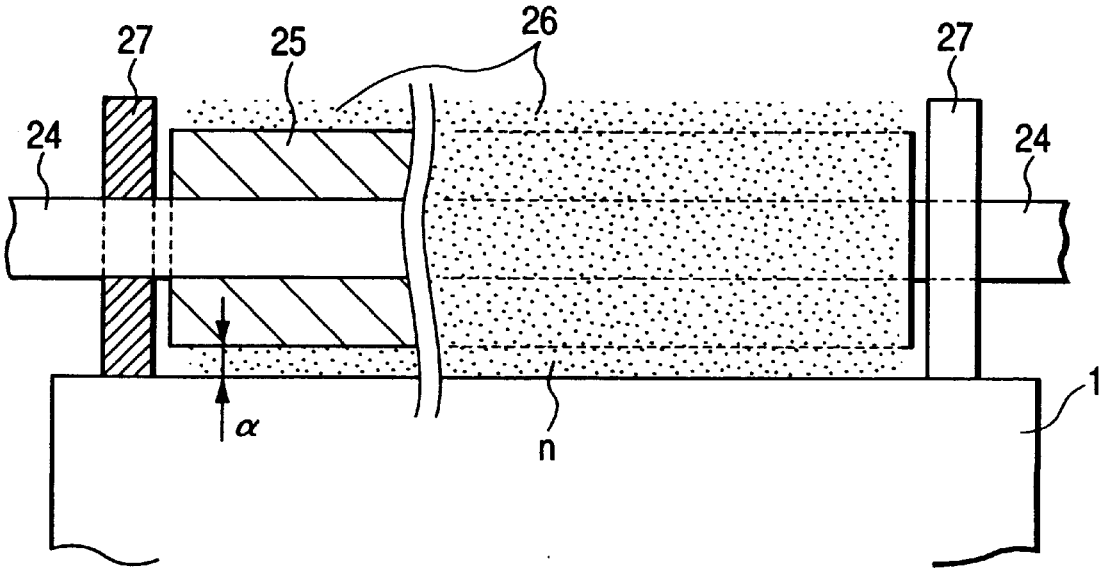

FIGS. 6A and 6B show an embodiment of the magnetic brush contact charging device. Reference numeral 23 denotes the magnetic brush charging member, which is of a magnetic roller rotating type composed of a core bar 24, a magnet roller 25 as a cylindrical multi-pole magnetic member coaxial and integral with the core bar around it, a magnetic brush layer 26 of magnetic powder (or magnetic particles or magnetic carriers) attracted and held as a magnetic brush by the magnetism of the magnet roller on the peripheral surface of the magnet roller 25, and spacer rollers 27, 27 of a disk shape fitted over the core bar 24 at the both ends thereof each so as to be rotatable in the present example. This magnetic brush charging member 23 is set approximately in parallel to the photosensitive member 1 and the spacer rollers 27, 27 on the both sides are always kept in a contact state with the surface of the photosensitive member 1 on the both sides, whereby the both sides of the core bar 24 are kept in a bearing support state.

The outside diameter of the spacer rollers 27, 27 is larger than the outside diameter of the magnet roller 25 but smaller than the outside diameter of the magnetic brush layer 26. Therefore, the spacer rollers 27, 27 function to regulate the closest clearance (gap) α between the magnet roller 25 and the photosensitive member 1 to a predetermined value. The clearance α is preferably within the range of 50 to 2000 μm and more preferably within the range of 100 to 1000 μm.

The magnetic brush layer 26 is in contact with the surface of the photosensitive member 1 between the photosensitive member 1 and the magnetic roller 25 to create a contact nip portion n. Since the closest clearance a between the photosensitive member 1 and the magnet roller 25 is regulated to the predetermined value by the spacer rollers 27, 27 as described above, the width of the contact nip portion n in the rotating direction of the photosensitive member is stabilized.

In the present example the magnet roller 25 of the charging member 23 is driven to rotate in the clockwise direction of the arrow opposite to the rotating direction of the photosensitive member 1 in the contact nip portion n, whereupon one surface of the rotating photosensitive member 1 is rubbed against the magnetic brush layer 26 in the contact nip portion n.

The predetermined charging bias voltage is applied from the power supply S through the core bar 24 and magnetic roller 25 to the magnetic brush layer 26 by the DC applying method or the AC applying method, whereby the peripheral surface of the photosensitive member 1 driven to rotate is uniformly charged in a predetermined polarity and at a predetermined potential by the contact charging method. The magnet roller 25 as a magnetic member is normally made of a ferrite magnet, a rubber magnet, and so on.

The magnetic powder is generally selected from magnetic iron oxide (ferrite powder), magnetite powder, known magnetic toner materials, and so on.

It is desirable to properly select the resistance of the charging member 23 according to the environment where it is used, high charging efficiency, withstand voltage characteristics of the surface layer of the photosensitive member, and so on.

There is also a sleeve rotating type in which an electrode sleeve of a material to be magnetized is fitted over the outside of the magnet roller 25, the magnetic brush layer 26 is formed and held by attracting and holding the magnetic powder as a magnetic brush by the magnetism of the inside magnetic roller 25 on the peripheral surface of the sleeve, and the sleeve is rotated.

The magnetic brush contact charging device of this type can improve the contact property and wear property of the image carrier and the contact charging member and can considerably improve the mechanical wear resistance etc. against endurance deterioration.

(c) Contact Charging Device with Fur Brush

Figure 7:
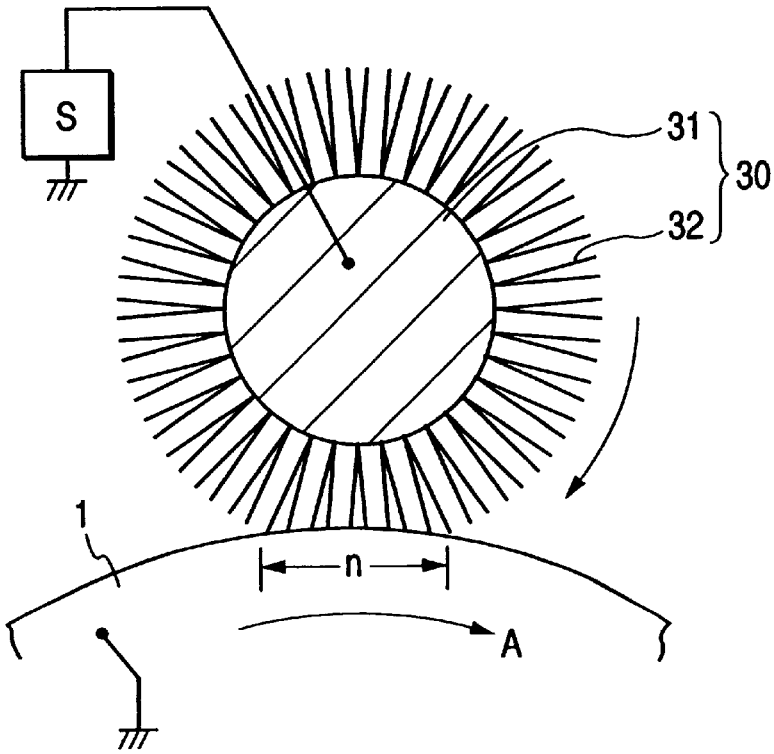
FIG. 7 is a schematic, structural view for explaining still another example of the contact charging apparatus.

Described next is an example of application of a fur brush to the contact charging member. FIG. 7 shows an embodiment of the fur brush contact charging device. Reference numeral 30 denotes a fur brush charging member, which is constructed in such structure that a brush-like contact member having an electrically conductive property, for example, a plated metal brush or a fiber brush with an electrically conductive material dispersed, is planted into the peripheral surface of a roller-like electrode member 31 to form a brush layer (fur brush) 32. The brush layer 32 is placed in contact with the photosensitive member 1 as a member to be charged, the fur brush charging member 30 is rotated, and the predetermined charging bias voltage is applied from the power supply to the electrode member 31 so as to charge the photosensitive member 1.

This fur brush contact charging device is free of the decrease of magnetic powder as experienced in the magnetic brush contact charging device, so that the maintenance intervals can be extended. Hair-like charging ununiformity with the fur brush can be canceled by rotating the fur brush charging member 30 at a high speed or in the direction opposite to the rotating direction of the photosensitive member in the contact nip portion n with the photosensitive member 1, whereby the image quality can be improved.

It was also verified that when the contact charging was compared with the corona charging under the same condition of charge-eliminating light, the contact charging was superior against the ghost. This is probably for the following reason.

In the case of the corona charging, since a uniform potential is directed downward, the charge is imparted irrespective of the potential difference of ghost. On the other hand, in the case of the contact charging, the charge is imparted according to the potential of the contact member. Therefore, it functions to cancel the potential difference of the ghost potential as generated.

When the magnetic powder brush was used as a contact charging member, reduction of the magnetic powder was encountered. However, the present invention drastically improved the reduction of magnetic powder. Namely, the present invention was considered to be able to improve the ghost level and depress the amount of the charge-eliminating light which decreased the chargeability and which increased dark decay. It was, therefore, considered that the dark decay after the charging was able to be reduced and a great improvement was able to be achieved in deposition of the magnetic powder.

[Image Forming Apparatus]

Figure 8:
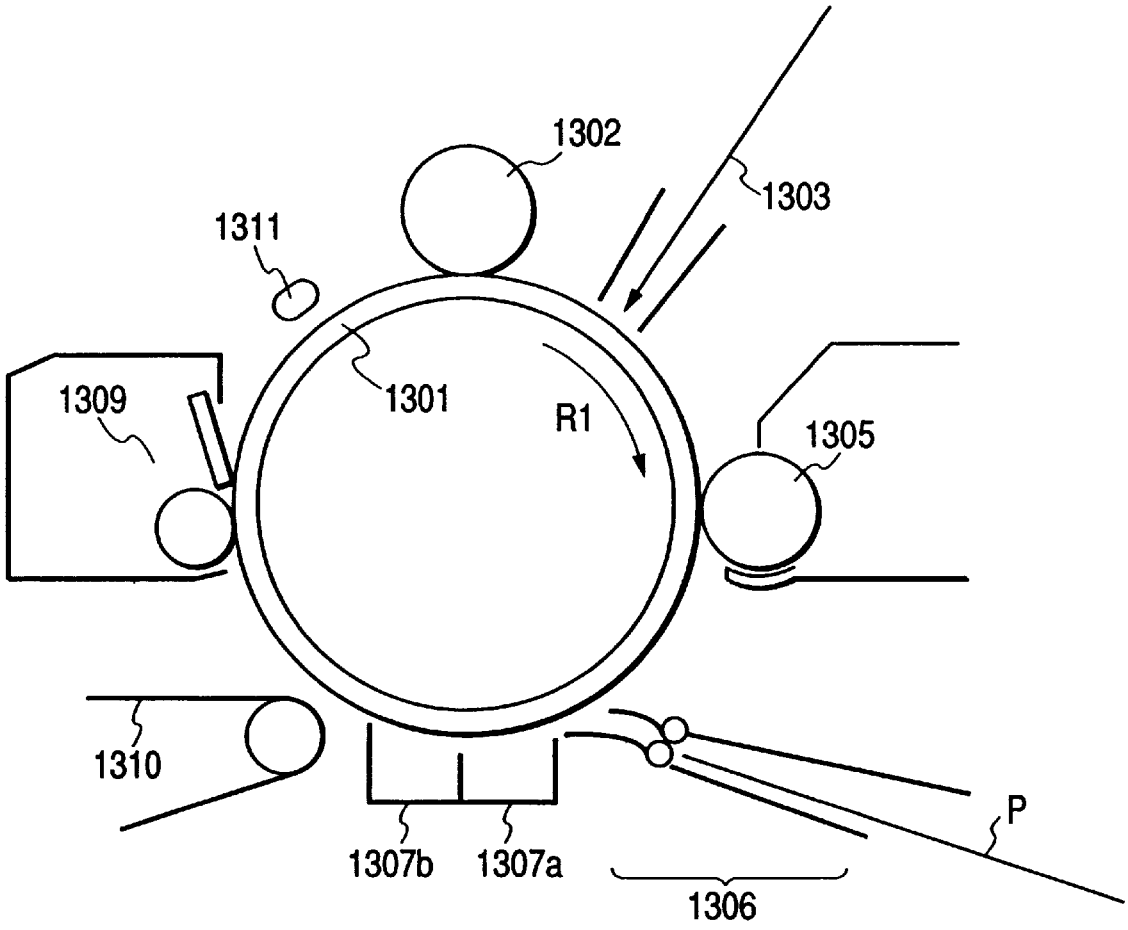
FIG. 8 is a schematic, structural view showing an example of the structure of the electrophotographic apparatus having the contact charging device.

FIG. 8 is a schematic view showing an example of the electrophotographic apparatus using the a-Si photosensitive member.

In FIG. 8, around the photosensitive member 1301 rotating in the direction of arrow R1 there are provided a primary charger 1302, an electrostatic latent image forming section 1303, a developing unit 1305, a transfer sheet supplying system 1306, a transfer charger 1307*a*, a separation charger 1307*b*, a cleaner 1309, a conveying system 1310, a charge-eliminating light source 1311, and so on. The present example shows an example of application of the contact charging device to the primary charger 1302. The image forming process will be described below with an example. The photosensitive member 1301 is uniformly charged by the primary charger 1302 of the roller shape. The charging member can be selected from those using the elastic rubber, the magnetic powder, and the fur brush with metal or graphite fibers so as to match with the resistance suitable for the charging. The light is guided and projected from the electrostatic latent image forming section onto the photosensitive member to form an electrostatic latent image thereon. A negative toner is supplied from the developing unit 1305 onto this latent image to form a toner image. On the other hand, a transfer sheet P is supplied through the transfer sheet supplying system 1306 toward the photosensitive member and is given a positive electric field of the opposite polarity to that of the toner from the back in the gap between the transfer charger 1307*a* under application of the high voltage of +7 to 8 kV and the photosensitive member 1301, whereby the negative toner image on the surface of the photosensitive member is transferred onto the transfer sheet P. After separated by the separation charger 1307*b* to which the high AC voltage of 12 to 14 kvp-p and 300 to 600 Hz is applied, the transfer sheet P is conveyed through the transfer sheet conveying system 1310 to the fixing device (not illustrated), in which the toner image is fixed. Then the transfer sheet is discharged out of the apparatus.

[Amorphous silicon based photosensitive member (a-Si)]

Figure 9A:
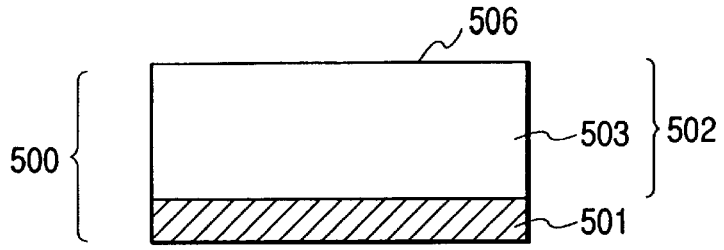
FIGS. 9A, 9B, 9C, and 9D are schematic, sectional views for explaining examples of layer structures of amorphous photosensitive members.
Figure 9B:
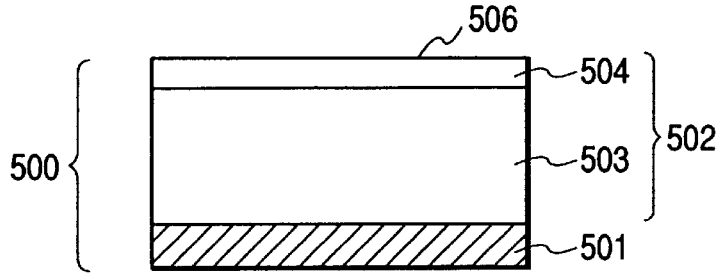

The light receiving layer of the photosensitive member suitably applicable in the present invention will be described in detail with reference to the drawings. FIGS. 9A to 9D are schematic, structural views for explaining examples of layer structures of photosensitive members for image-forming apparatus. In the photosensitive member 500 for image-forming apparatus illustrated in FIG. 9A, the photosensitive layer 502, which is the light receiving layer, is laid on the support 501 for photosensitive member. The photosensitive layer 502 is comprised of a photoconductive layer 503 with the photoconductive property made of amorphous silicon containing hydrogen atoms or halogen atoms in the matrix of silicon atoms (a-Si:H, X). FIG. 9B is a schematic, structural view for explaining another layer structure of the photosensitive member for image-forming apparatus. In the photosensitive member 500 for image-forming apparatus illustrated in FIG. 9B, the photosensitive layer 502 is laid on the support 501 for photosensitive member. The photosensitive layer 502 has a photoconductive layer 503 with the photoconductive property comprised of a-Si:H, X and an amorphous silicon based or amorphous carbon based surface layer 504.

Figure 9C:
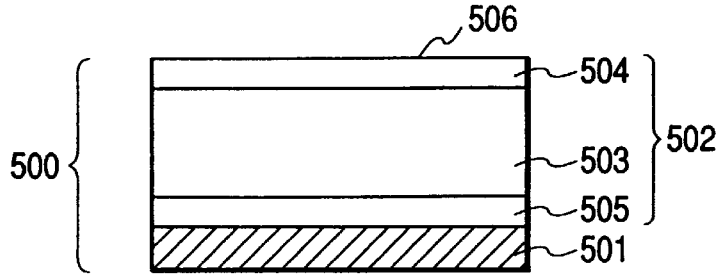

FIG. 9C is a schematic, structural view for explaining another layer structure of the photosensitive member for image-forming apparatus. In the photosensitive member 500 for image-forming apparatus illustrated in FIG. 9C, the photosensitive layer 502 is laid on the support 501 for photosensitive member. The photosensitive layer 502 has a photoconductive layer 503 with the photoconductive property comprised of a-Si:H, X, an amorphous silicon based or amorphous carbon based surface layer 504, and an amorphous silicon based charge injection inhibiting layer 505.

Figure 9D:
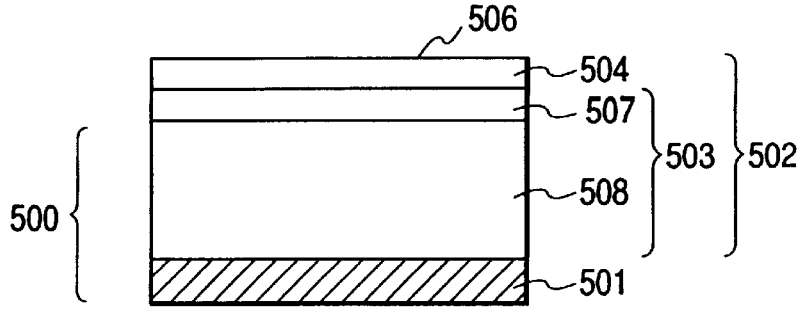

FIG. 9D is a schematic, structural view for explaining still another layer structure of the photosensitive member for image-forming apparatus. In the photosensitive member 500 for image-forming apparatus illustrated in FIG. 9D, the photosensitive layer 502 is laid on the support 501 for photosensitive member. The photosensitive layer 502 has a charge generating layer 507 and a charge transport layer 508, which are comprised of a-Si:H, X and which compose the photoconductive layer 503, and an amorphous silicon based or amorphous carbon based surface layer 504.

The present invention will be described in detail with experimental examples and examples thereof. It is noted that the present invention is by no means intended to be limited to these experimental examples and examples.

EXPERIMENT 1

Using an apparatus for fabricating the photosensitive member for image forming apparatus by the RF-PCVD process, the charge injection inhibiting layer, photoconductive layers, and surface layer were formed under the conditions shown in Table 1 on a mirror-finished aluminum cylinder having the diameter of 108 mm, thereby obtaining the photosensitive member.

TABLE 1

| | Charge Injection Inhibiting Layer | Photoconductive Layer 1 | Photoconductive Layer 2 | Surface Layer |
|---|---|---|---|---|
| Gas Species and Flow Rates | | | | |
| $SiH_4$ [sccm] | 100 | 200 | 200 | 10 |
| $H_2$ [sccm] | 300 | 800 | 800 | |
| $B_2H_6$ [ppm] (with respect to $SiH_4$) | 2000 | 2 | 0.5 | |
| NO [sccm] | 50 | | | |
| $CH_4$ [sccm] | | | | 500 |
| Temperature of Support [° C.] | 290 | 290 | 290 | 290 |
| Internal Pressure [Torr] | 0.5 | 0.5 | 0.5 | 0.5 |
| RF Power [W] | 500 | 800 | 400 | 300 |
| Film Thickness [μm] | 3 | 20 | 7 | 0.5 |

The ratios of the memory of exposure before charging to the sensitivity were determined for this photosensitive member and the results are shown in FIG. 4.

The photosensitive member thus produced was set in an image forming apparatus for digital tests obtained by modifying NP6060 (trade name) manufactured by CANON Inc., and the chargeability and ghost potential were evaluated.

An LED of 680 nm was used for the charge-eliminating exposure light and an LED head of 700 nm for the image exposure light. The photosensitive member was rotated at the rate of 300 mm/s. The measurement of chargeability was made by adopting a value when the current of the primary charger was 1000 μA. The measurement of the ghost potential was made by measuring a dark area potential after one rotation of the photosensitive member from exposure at the dark area potential of 400 V and the exposed area potential of 50 V.

Figure 10:
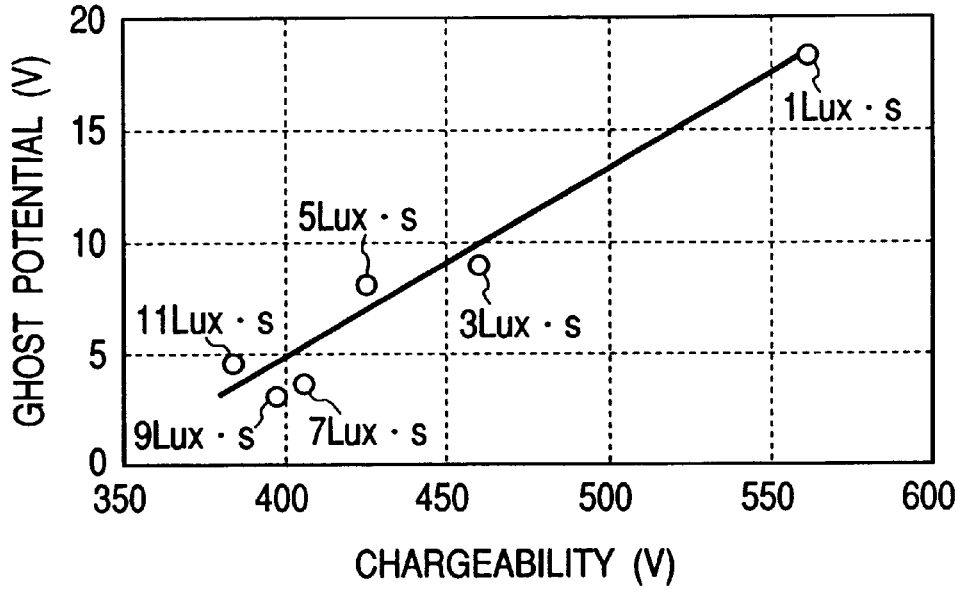
FIG. 10 is a plot showing an example of the relationship between chargeability and ghost potential against difference of charge-eliminating exposure quantity.

First, in order to check how much the ghost was able to be canceled by increase of light quantity of the charge-eliminating exposure, the light quantity of the charge-eliminating exposure was changed from 1 Lux·s to 11 Lux·s under the above conditions to obtain the ghost potential and chargeability at each image exposure light wavelength. As a result, as illustrated in FIG. 10, the potential appearing as a ghost decreased with increasing light quantity of the charge-eliminating exposure, whereas the chargeability decreased therewith. It is thus apparent that it is not possible to satisfy both the ghost and chargeability by simply increasing the light quantity of charge-eliminating exposure.

Figure 11:
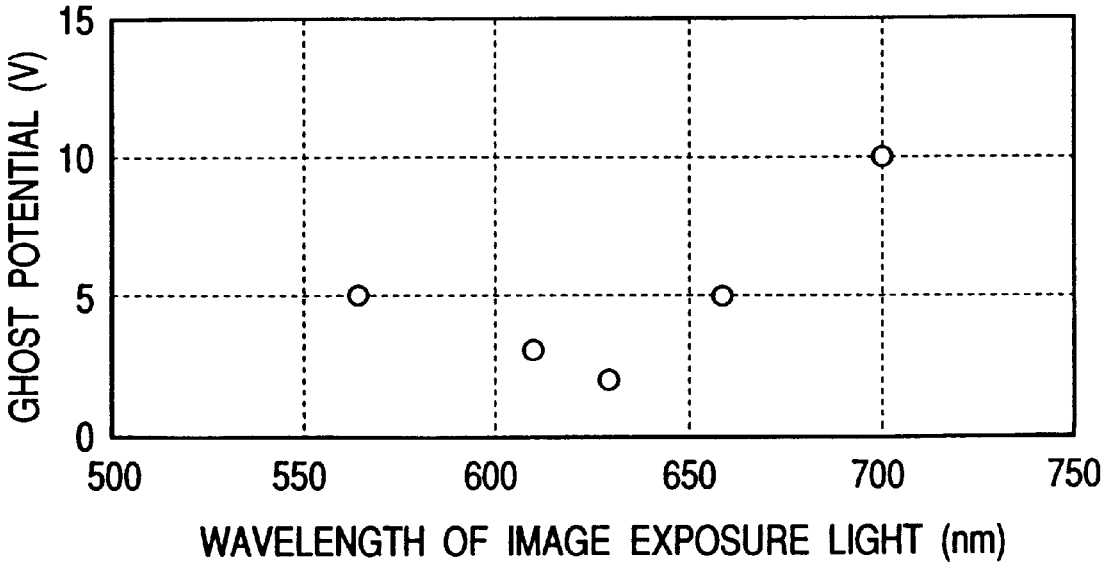
FIG. 11 is a view showing an example of ghost potential against exposure wavelength.

Next, while the light quantity of pre-exposure was fixed at 4 Lux·s, the wavelength of the image exposure light was varied. While LED heads of 565 nm, 610 nm, 660 nm, and 700 nm were used as a light source for the image exposure, the ghost potential was measured. The results are shown in FIG. 11. From the result, the ghost potential was improved with the use of the LEDs of 565 nm, 610 nm, and 660 nm as the light source for the image exposure, as compared with the use of the LED head of 700 nm as a light source for the image exposure.

EXPERIMENT 2

The chargeability and ghost potential of the photosensitive member produced in Experiment 1 were evaluated using the image forming apparatus of Experiment 1. Semiconductor lasers of 635 nm, 650 nm, 680 nm, and 788 nm were used as a light source for the image exposure. The charge-eliminating exposure light source was one having the wavelength 680 nm and the light quantity of 4 Lux·s.

Figure 12:
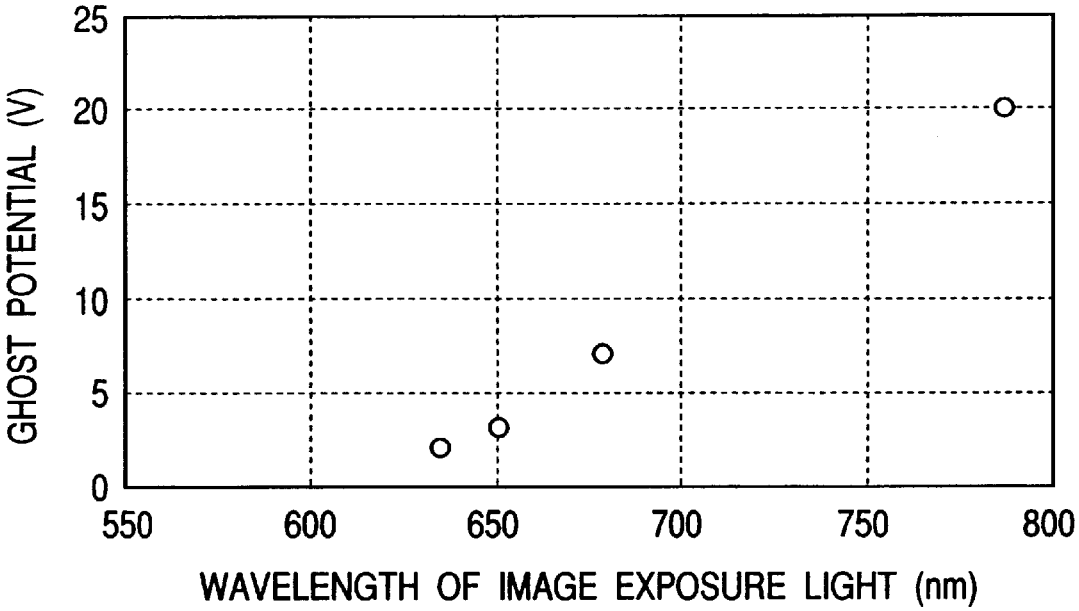
FIG. 12 is a view showing an example of ghost potential against exposure wavelength.

It is seen from the results shown in FIG. 12 that the ghost potential is improved with the use of the semiconductor lasers of 635 nm and 650 nm as a light source for the image exposure.

As apparent from Experiments 1 and 2, the ghost memory is improved by use of such an image exposure light source as to make the ratio of optical memory before charging to sensitivity as small as possible, and as a result, the light quantity of the charge-eliminating exposure can be made smaller than before. Therefore, the chargeability can also be increased.

EXPERIMENT 3

Figure 13:
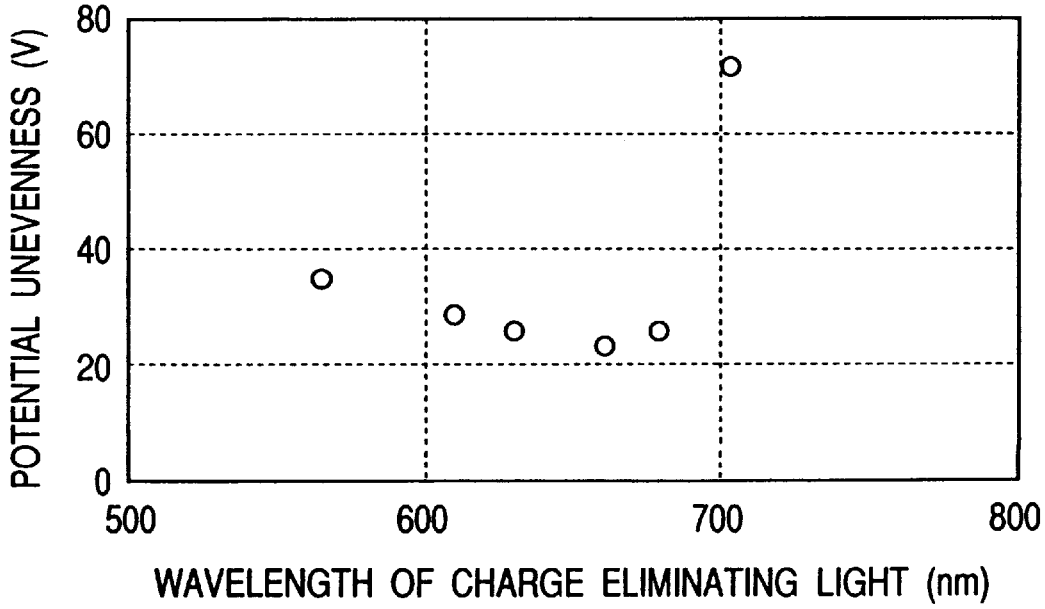
FIG. 13 is a view showing an example of potential unevenness against charge-eliminating exposure wavelength.

Without execution of the image exposure the potential unevenness of the dark area potential was checked against the wavelength of charge-eliminating light. FIG. 13 shows the potential unevenness where the charging potential was adjusted to 400 V. There is such a trend that the potential unevenness increases abruptly within the range where the charge-eliminating wavelength is not less than 680 nm. The peripheral unevenness became gradually increased with decreasing wavelength. From this result, it was verified that the wavelength of the charge-eliminating exposure light was preferably not less than 600 nm nor more than 680 nm and more preferably not less than 630 nm nor more than 680 nm.

EXPERIMENT 4

Figure 14:
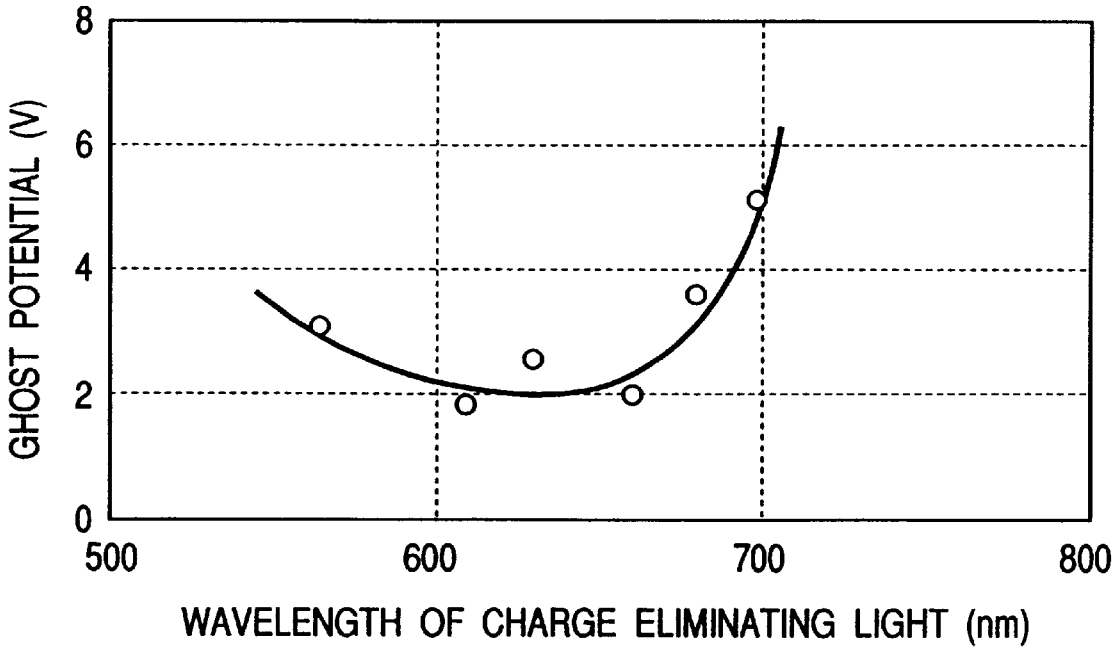
FIG. 14 is a view showing an example of ghost memory against charge-eliminating exposure wavelength.

The effect of the charge-eliminating exposure on the ghost was evaluated. While the primary current was fixed at 1000 μA, the light quantity of the charge-eliminating light source was matched at each wavelength so as to obtain the chargeability of 400 V. Using a laser light source of 650 nm as an image exposure light source, an adjustment was made such that the exposed area potential was 50 V and the contrast potential was 350 V. FIG. 14 shows the ghost potentials when the wavelength of the charge-eliminating light was varied at this time. It was verified that the ghost was improved by the use of the charge-eliminating exposure light within the wavelength range of not less than 600 nm nor more than 680 nm for charge-eliminating light.

EXPERIMENT 5

Figure 15:
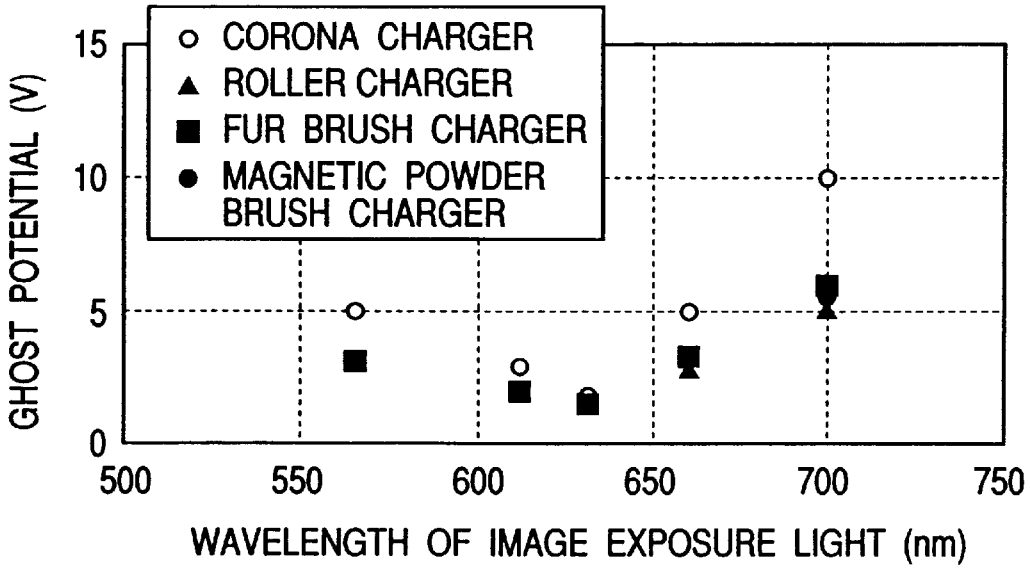
FIG. 15 is a view showing an example of ghost potential against exposure wavelength.

Using the photosensitive member and image forming apparatus used in Experiment 1, the ghost potential was evaluated with regard to the types of the charging members. While the charge-eliminating light was given from the LED of 680 nm fixed at the light quantity of 4 Lux·s, the ghost potential was measured for the charging members at various wavelengths of the image exposure. As the light source for the image exposure LED heads of 565 nm, 610 nm, 660 nm, and 700 nm were used. The charging members used herein were (1) the corona charger, (2)-1 the roller charger, (2)-2 the fur brush charger, and (2)-3 the magnetic powder brush charger. The results are shown in FIG. 15. As apparent from FIG. 15, the ghost potential was improved by the use of the contact chargers, as compared with that in the use of the corona charger.

EXPERIMENT 6

Figure 16:
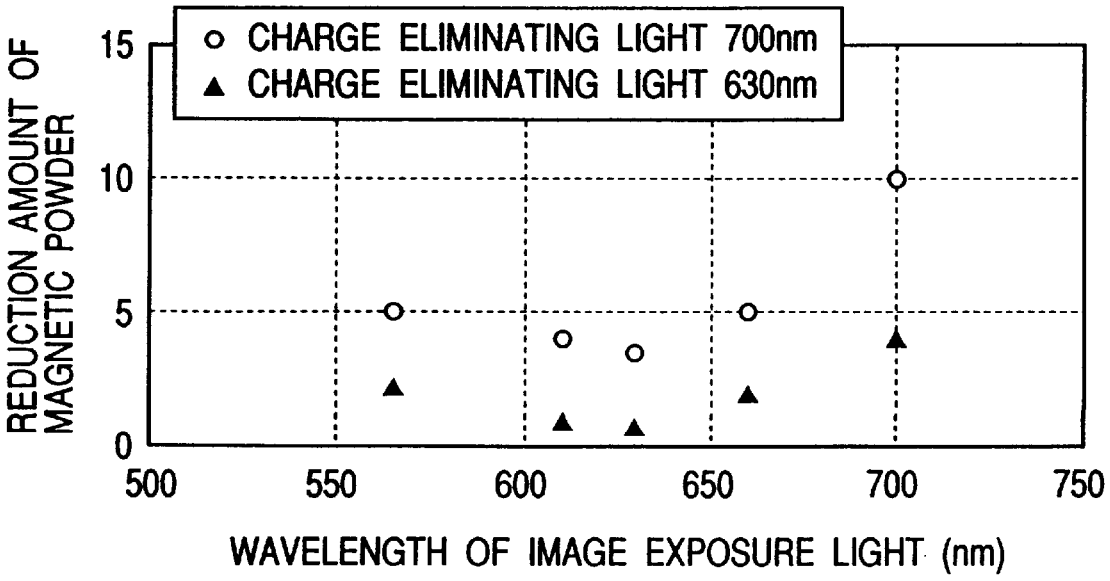
FIG. 16 is a view showing an example of decrease of magnetic powder against exposure wavelength.

The magnetic powder brush charger used in Experiment 5 was subjected to durability tests under different exposure conditions. In that case the reduction amounts of the magnetic powder of the magnetic powder brush were investigated. The tests were conducted under such conditions that the charge-eliminating exposure dose and charging conditions were adjusted so as to make the dark area potential at 400 V, the light area potential at 50 V, and the ghost potential constant. FIG. 16 shows the result of reduction amounts of magnetic powder where the reduction amount at the charge-eliminating exposure of 700 nm and the image exposure of 700 nm was normalized to 10. In this case, the effect was recognized in preventing the reduction of magnetic powder.

EXAMPLE 1

The photosensitive member fabricated in Experiment 1 was subjected to image evaluation, using the image forming apparatus used in Experiment 1. The charging was the corona charging and the semiconductor laser of 635 nm was used as an image exposure light source. The charge-eliminating exposure was implemented using the LED of 660 nm and the photosensitive member was rotated at the rate of 300 mm/s. At this time the chargeability obtained was enough to form the image.

Next, evaluation with images was conducted while setting the dark area potential to 400 V and the light area potential to 50 V. Original images for evaluation were a white image, a black image, a 50%-reflecting image, a ghost image, and a plotting sheet of 0.5 mm squares. In either case a good image was obtained. Particularly, even if the ghost image was used as the original image for evaluation, there appeared no ghost in the electrophotographic image, and a good image was obtained.

EXAMPLE 2

The photosensitive member fabricated in Experiment 1 was subjected to image evaluation, using the image forming apparatus used in Experiment 1. The charging was the corona charging and the semiconductor laser of 650 nm was used as an image exposure light source. The charge-eliminating exposure was implemented using the LED of 700 nm and the photosensitive member was rotated at the rate of 260 mm/s. At this time the chargeability obtained was enough to form the image.

Next, the same evaluation as in Example 1 was carried out. In either case, a good image was obtained. Particularly, there appeared no ghost even with the use of the ghost image and, therefore, the image obtained was good.

EXAMPLE 3

The photosensitive member fabricated in Experiment 1 was subjected to image evaluation, using the image forming apparatus used in Experiment 1. The charging was the corona charging and the LED head of 650 nm was used as an image exposure light source. The charge-eliminating exposure was implemented using the LED of 660 nm and the photosensitive member was rotated at the rate of 260 mm/s. At this time the chargeability obtained was enough to form the image.

Next, the same evaluation as in Example 1 was carried out. In either case, a good image was obtained. Particularly, there appeared no ghost even with the use of the ghost image and, therefore, the image obtained was good.

EXAMPLE 4

The photosensitive member fabricated in Experiment 1 was subjected to image evaluation, using the image forming apparatus used in Experiment 1. The charging was the corona charging and the LED head of 630 nm was used as an image exposure light source. The charge-eliminating exposure was implemented using the LED of 680 nm and the photosensitive member was rotated at the rate of 360 mm/s. At this time the chargeability obtained was enough to form the image.

Next, the same evaluation as in Example 1 was carried out. In either case, a good image was obtained. Particularly, there appeared no ghost even with the use of the ghost image and, therefore, the image obtained was good.

EXAMPLE 5

The photosensitive member fabricated in Experiment 1 was subjected to image evaluation, using the image forming apparatus used in Experiment 1. The charging was the corona charging and the semiconductor laser of 650 nm was used as an image exposure light source. The charge-eliminating light was implemented using the LED of 630 nm and the photosensitive member was rotated at the rate of 260 mm/s. At this time the chargeability obtained was enough to form the image. Next, the same evaluation as in Example 1 was carried out. In either case, a good image was obtained. Particularly, there appeared no ghost even with the use of the ghost image and, therefore, the image obtained was good.

EXAMPLE 6

The photosensitive member fabricated in Experiment 1 was subjected to image evaluation, using the image forming apparatus used in Experiment 1. The charging was the corona charging and the LED head of 650 nm was used as an image exposure light source. The charge-eliminating light was implemented using the LED of 610 nm and the photosensitive member was rotated at the rate of 260 mm/s. At this time the chargeability obtained was enough to form the image. Next, the same evaluation as in Example 1 was carried out. In either case, a good image was obtained. Particularly, there appeared no ghost even with the use of the ghost image and, therefore, the image obtained was good.

EXAMPLE 7

The photosensitive member fabricated in Experiment 1 was subjected to image evaluation, using the image forming apparatus used in Experiment 1. The charger used herein was the magnetic powder brush charger and the semiconductor laser of 635 nm was used as an image exposure light source. The charge-eliminating light was implemented using the LED of 660 nm and the photosensitive member was rotated at the rate of 300 mm/s. At this time the chargeability obtained was enough to form the image. Next, the evaluation with images was conducted while setting the dark area potential to 400 V and the light area potential to 50 V. The original images for evaluation were a white image, a black image, a 50%-reflecting image, a ghost image, and a plotting sheet of 0.5 mm squares. In either case a good image was obtained. Particularly, there appeared no ghost with the use of the ghost image and the image obtained was good.

EXAMPLE 8

The photosensitive member fabricated in Experiment 1 was subjected to image evaluation, using the image forming apparatus used in Experiment 1. The charger used was the fur brush charger and the semiconductor laser of 650 nm was used as an image exposure light source. The charge-eliminating light was implemented using the LED of 630 nm and the photosensitive member was rotated at the rate of 260 mm/s. At this time the chargeability obtained was enough to form the image. Next, the same evaluation as in Example 1 was carried out and in either case a good image was obtained. Particularly, there appeared no ghost with the use of the ghost image and the image obtained was good.

EXAMPLE 9

The photosensitive member fabricated in Experiment 1 was subjected to image evaluation, using the image forming apparatus used in Experiment 1. The charger used was the roller charger and the LED head of 650 nm was used as an image exposure light source. The charge-eliminating light was implemented using the LED of 610 nm and the photosensitive member was rotated at the rate of 260 mm/s. At this time the chargeability obtained was enough to form the image. Next, the same evaluation as in Example 1 was carried out and in either case a good image was obtained. Particularly, there appeared no ghost with the use of the ghost image and the image obtained was good.

EXAMPLE 10

The photosensitive member fabricated in Experiment 1 was subjected to image evaluation, using the image forming apparatus used in Experiment 1. The charger used was the magnetic powder brush charger and the LED head of 630 nm was used as an image exposure light source. The charge-eliminating light was implemented using the LED of 680 nm and the photosensitive member was rotated at the rate of 360 mm/s. At this time the chargeability obtained was enough to form the image. Next, the same evaluation as in Example 1 was carried out and in either case a good image was obtained. Particularly, there appeared no ghost with the use of the ghost image and the image obtained was good.

According to the present invention, it is possible to improve the ghost memory even under the conditions such as the increased operating speed and the decreased device size and to provide the electrophotographic process and the electrophotographic apparatus with high chargeability. Particularly, the ghost memory is improved effectively and there appears no ghost on the image without increase of the charge-eliminating light quantity and the like.

Further, when the semiconductor laser is used as an image exposure light source, the spot size can be decreased, which can realize the image with much higher quality.

In addition, the present invention becomes more effective when combined with the contact charging. Among others, where the magnetic powder brush is used as the contact charging member, the reduction of magnetic powder can be improved drastically.

What is claimed is:

1. An electrophotographic process of forming an image through a series of steps comprising a charge eliminating step of eliminating charge from a surface of a photosensitive member having a light receiving layer, a charging step of charging the surface of the photosensitive member, a latent image exposure step of exposing the charged surface of the photosensitive member to light to form an electrostatic latent image thereon, and a development step of supplying a toner onto the electrostatic latent image to develop the image to form a toner image, wherein the light receiving layer comprises an amorphous semiconductor, and wherein the light used in the latent image exposure step is light of a wavelength within such a range that a value obtained by dividing a difference between a charging potential when the photosensitive member is not exposed to light before the charging of the photosensitive member and a charging potential when the photosensitive member is charged after exposure to light of a desired wavelength, by a sensitivity at the wavelength to make the difference between the charging potentials, is not more than 1.5 times a minimum value thereof.

2. The electrophotographic process according to claim 1, wherein the light of the wavelength within the range is light from a single-wavelength light source.

3. The electrophotographic process according to claim 1, wherein the light of the wavelength within the range has a main wavelength within the range.

4. The electrophotographic process according to claim 1, wherein the amorphous semiconductor is amorphous silicon.

5. The electrophotographic process according to claim 1, wherein the light of the wavelength within the range is light within a wavelength range of not less than 500 nm nor more than 680 nm.

6. The electrophotographic process according to claim 1, wherein the light of the wavelength within the range has a main wavelength within a range of not less than 600 nm nor more than 660 nm.

7. The electrophotographic process according to claim 1, wherein the charge eliminating step comprises effecting exposure for charge elimination.

8. The electrophotographic process according to claim 7, wherein the exposure for charge elimination is carried out using light of a wavelength not less than 600 nm nor more than 680 nm.

9. The electrophotographic process according to claim 7, wherein the peak wavelength of the light of the exposure for charge elimination is a wavelength not less than 630 nm nor more than 680 nm.

10. The electrophotographic process according to claim 1, wherein the charging step is carried out using corona charging.

11. The electrophotographic process according to claim 1, wherein the charging step is carried out using contact charging.

12. The electrophotographic process according to claim 1, wherein the charging step comprises applying a voltage to a charging member in such a state that the charging member is in contact with the surface of the photosensitive member.

13. The electrophotographic process according to claim 12, wherein the charging member is a rubber roller.

14. The electrophotographic process according to claim 12, wherein the charging member is a fur brush.

15. The electrophotographic process according to claim 12, wherein the charging member is a magnetic powder brush.

16. The electrophotographic process according to claim 1, wherein the charge eliminating step comprises effecting exposure for charge elimination, and wherein the charging step is carried out using corona charging.

17. The electrophotographic process according to claim 16, wherein the exposure for charge elimination is carried out using light of a wavelength not less than 600 nm nor more than 680 nm.

18. The electrophotographic process according to claim 16, wherein the peak wavelength of the light of the exposure for charge elimination is a wavelength not less than 630 nm nor more than 680 nm.

19. The electrophotographic process according to claim 1, wherein the charge eliminating step comprises effecting exposure for charge elimination, and wherein the charging step is carried out using contact charging.

20. The electrophotographic process according to claim 1, wherein the charge eliminating step comprises effecting exposure for charge elimination, and wherein the charging step comprises applying a voltage to a charging member in such a state that the charging member is in contact with the surface of the photosensitive member.

21. The electrophotographic process according to claim 20, wherein the exposure for charge elimination is carried out using light of a wavelength not less than 600 nm nor more than 680 nm.

22. The electrophotographic process according to claim 20, wherein the peak wavelength of the light of the exposure for charge elimination is a wavelength not less than 630 nm nor more than 680 nm.

23. The electrophotographic process according to claim 20, wherein the charging member is a rubber roller.

24. The electrophotographic process according to claim 20, wherein the charging member is a fur brush.

25. The electrophotographic process according to claim 20, wherein the charging member is a magnetic powder brush.

26. An electrophotographic apparatus comprising a photosensitive member having a light receiving layer, a charge eliminating means for eliminating charge from a surface of the photosensitive member, a charging means for charging the surface of the photosensitive member, a latent image exposure means for exposing the charged surface of the photosensitive member to light to form an electrostatic latent image thereon, and a developing means for supplying a toner onto the electrostatic latent image to develop the image to form a toner image, wherein the light receiving layer comprises an amorphous semiconductor, and wherein the latent image exposure means comprises a light source for emitting light of a wavelength within such a range that a value obtained by dividing a difference between a charging potential when the photosensitive member is not exposed to light before the charging of the photosensitive member and a charging potential when the photosensitive member is charged after exposure to light of a desired wavelength, by a sensitivity at the wavelength to make the difference between the charging potentials, is not more than 1.5 times a minimum value thereof.

27. The electrophotographic apparatus according to claim 26, wherein the light source is a light source that emits light of a wavelength not less than 500 nm nor more than 680 nm.

28. The electrophotographic apparatus according to claim 26, wherein the light source is a light source that emits light of a peak wavelength not less than 600 nm nor more than 660 nm.

29. The electrophotographic apparatus according to claim 26, wherein the light source is an LED or a semiconductor laser.

30. The electrophotographic apparatus according to claim 26, wherein the charge eliminating means comprises a light source for charge elimination.

31. The electrophotographic apparatus according to claim 26, wherein the amorphous semiconductor is amorphous silicon.

32. The electrophotographic apparatus according to claim 30, wherein the light source for charge elimination is a light source that emits light of a wavelength not less than 600 nm nor more than 680 nm.

33. The electrophotographic apparatus according to claim 30, wherein the light source for charge elimination is a light source that emits light having a peak wavelength not less than 630 nm nor more than 680 nm.

34. The electrophotographic apparatus according to claim 26, wherein the charging means is means for performing corona charging.

35. The electrophotographic apparatus according to claim 26, wherein the charging means comprises a charging member capable of applying a voltage to the surface of the photosensitive member in a contact state therewith.

36. The electrophotographic apparatus according to claim 35, wherein the charging member is a rubber roller.

37. The electrophotographic apparatus according to claim 35, wherein the charging member is a fur brush.

38. The electrophotographic apparatus according to claim 35, wherein the charging member is a magnetic powder brush.

39. The electrophotographic apparatus according to claim 26, wherein the charge eliminating means comprises a light source for charge elimination, and wherein the charging means comprises a charging member capable of applying a voltage to the surface of the photosensitive member in a contact state therewith.

40. The electrophotographic apparatus according to claim 39, wherein the charging member is a rubber roller.

41. The electrophotographic apparatus according to claim 39, wherein the charging member is a fur brush.

42. The electrophotographic apparatus according to claim 39, wherein the charging member is a magnetic powder brush.

43. The electrophotographic apparatus according to claim 39, wherein the light source for charge elimination is a light source that emits light of a wavelength not less than 600 nm nor more than 680 nm.

44. The electrophotographic apparatus according to claim 39, wherein the light source for charge elimination is a light source that emits light having a peak wavelength not less than 630 nm nor more than 680 nm.

45. An electrophotographic process of forming an image by performing charge elimination, charging, latent image exposure and developments to a photosensitive member, wherein the photosensitive member comprises a light receiving layer comprising an amorphous material, and wherein image exposure for latent image formation is carried out using a light having a wavelength within such a range that a value of optical memory with regard to a unit contrast potential is not more than 1.5 times a minimum value thereof, and wherein exposure for charge elimination is carried out using a light source of a wavelength of not less than 600 nm nor more than 680 nm.

46. The electrophotographic process according to claim 45, wherein the exposure light source used for the image exposure for latent image formation is a laser or LED.

47. The electrophotographic process according to claim 45, wherein the amorphous material comprises amorphous silicon.

48. An electrophotographic apparatus comprising a photosensitive member, a charge eliminating means, a charging means, a latent image exposure means, a developing means and an image transfer means, wherein the photosensitive member comprises a light receiving layer comprising an amorphous material, and wherein the latent image exposure means comprises an exposure light source for use in image exposure for latent image formation which emits a light of a wavelength within such a range that a value of optical memory with regard to a unit contrast potential is not more than 1.5 times a minimum value thereof.

49. The electrophotographic apparatus according to claim 48, wherein the charge eliminating means comprises a light source which emits a light of a wavelength of not less than 630 nm nor more than 680 nm.

50. The electrophotographic apparatus according to claims 48 or 49, wherein the exposure light source is a laser or LED.

51. The electrophotographic apparatus according to claims 48 or 49, wherein the amorphous material comprises amorphous silicon.

* * * * *

UNITED STATES PATENT AND TRADEMARK OFFICE

CERTIFICATE OF CORRECTION

PATENT NO. : 6,240,269 B1
DATED : May 29, 2001
INVENTOR(S) : Takaaki Kaya et al.

It is certified that error appears in the above-identified patent and that said Letters Patent is hereby corrected as shown below:

Column 3,
Line 2, “of” should read -- of an --.

Column 10,
Line 23, “a” should read -- α --.

Column 12,
Line 11, “14 kvp-p” should read -- 14kVp-p --.

Column 20,
Lines 61 and 64, “claims 48” should read -- claim 48 --.

Signed and Sealed this

Thirteenth Day of September, 2005

JON W. DUDAS
*Director of the United States Patent and Trademark Office*